US006769360B2

(12) United States Patent
Walling

(10) Patent No.: US 6,769,360 B2
(45) Date of Patent: Aug. 3, 2004

(54) ELECTRONIC STAMP

(75) Inventor: Alex Walling, Solna (SE)

(73) Assignee: Print Dreams Europe AB, Kista (SE)

( * ) Notice: Subject to any disclaimer, the term of this patent is extended or adjusted under 35 U.S.C. 154(b) by 0 days.

(21) Appl. No.: 10/332,021

(22) PCT Filed: Jul. 6, 2001

(86) PCT No.: PCT/SE01/01575

§ 371 (c)(1),
(2), (4) Date: Jan. 3, 2003

(87) PCT Pub. No.: WO02/02343

PCT Pub. Date: Jan. 10, 2002

(65) Prior Publication Data

US 2003/0106447 A1 Jun. 12, 2003

(30) Foreign Application Priority Data

Jul. 6, 2000 (SE) ..... 0002552

(51) Int. Cl.[7] ..... B41F 31/00

(52) U.S. Cl. ..... 101/327; 101/103; 101/112; 101/368; 400/88; 347/109

(58) Field of Search ..... 101/327, 103, 101/112, 368; 400/88; 347/109

(56) References Cited

U.S. PATENT DOCUMENTS 4,899,228 A * 2/1990 Sano et al. ..... 358/473
4,947,262 A * 8/1990 Yajima et al. ..... 358/296
4,999,016 A * 3/1991 Suzuki et al. ..... 400/88
5,024,541 A * 6/1991 Tsukada et al. ..... 400/88
5,063,451 A * 11/1991 Yanagisawa et al. ..... 346/143
5,593,236 A * 1/1997 Bobry ..... 400/88
5,634,730 A * 6/1997 Bobry ..... 400/88
5,825,995 A * 10/1998 Wiklof et al. ..... 358/1.18
5,927,872 A * 7/1999 Yamada ..... 400/88

FOREIGN PATENT DOCUMENTS

| | | |
|---|---|---|
| DE | 3806356 | 6/1988 |
| GB | 2236985 | 4/1991 |

* cited by examiner

*Primary Examiner*—Andrew H. Hirshfeld
*Assistant Examiner*—Andrea H. Evans
(74) *Attorney, Agent, or Firm*—Dickstein Shapiro Morin & Oshinsky, LLP

(57) ABSTRACT

An electronic stamp or method for performing stamps where one or several sets of phototransistors (8), with associated light emitting diodes (9), are mounted on a print head (3) that is hand-operated along beams (5) with the aid of a lever (4) coupled to an upper stamp housing (1). The phototransistors (8) generate signals used by a micro controller circuit (12) in order to in real time calculate positioning parameters about the print head (3), and thus be able to steer and control a stream of ink drops intended to form a predetermined printout pattern.

21 Claims, 9 Drawing Sheets

Fig. 1
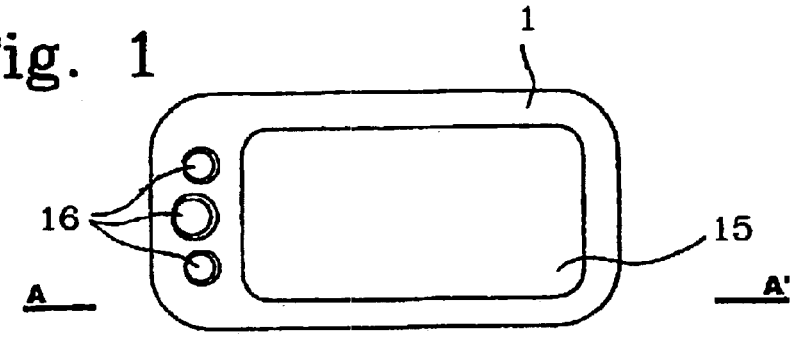
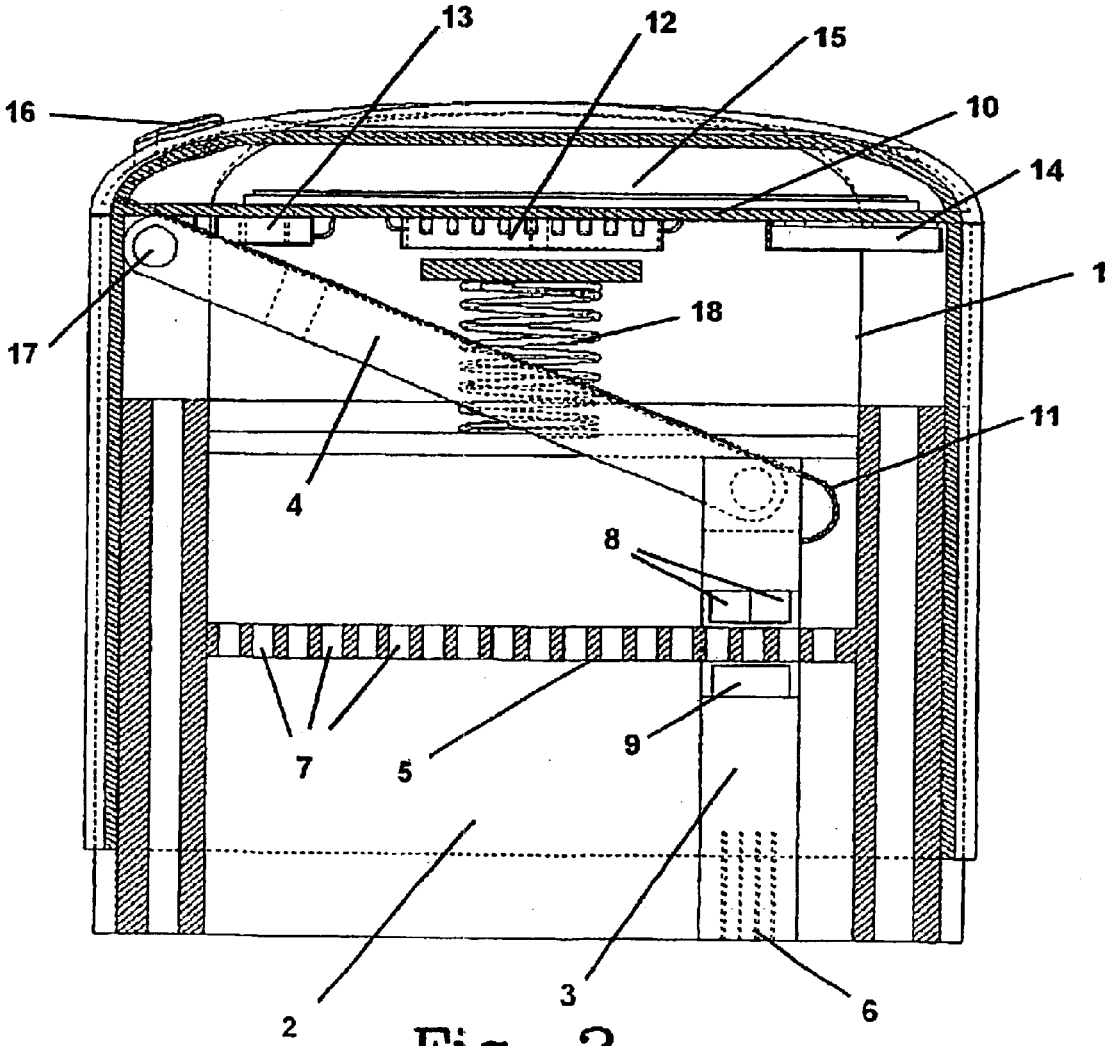
Fig. 2

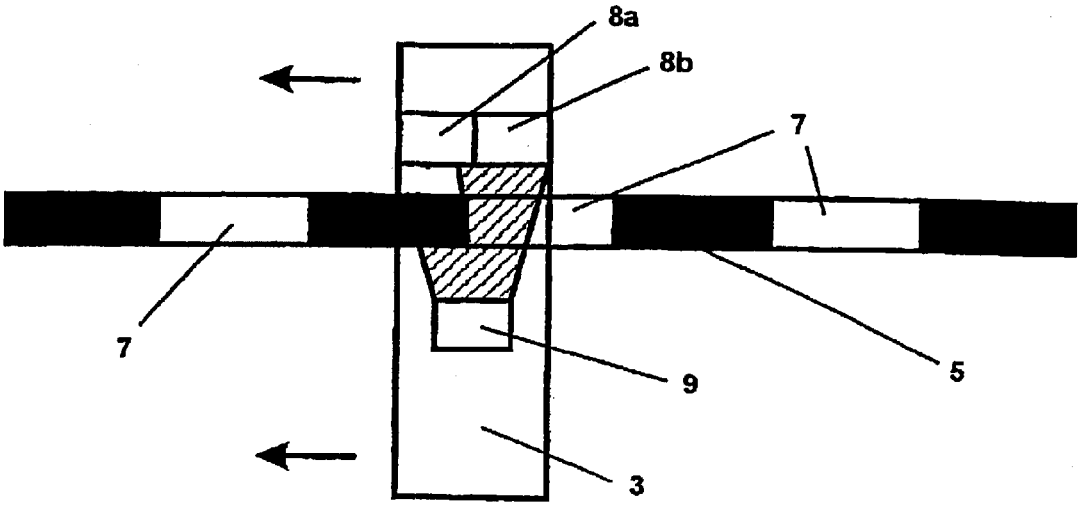
Fig. 5
Fig. 5a
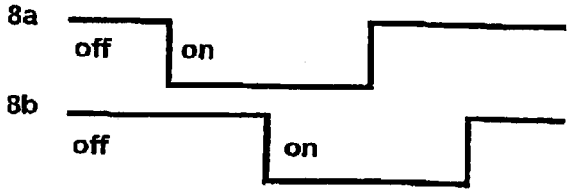
Fig. 5b
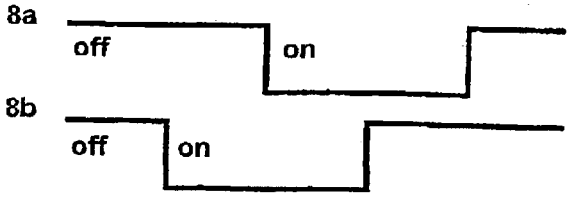

ELECTRONIC STAMP

FIELD OF THE INVENTION

The invention relates to an electronic stamp and a method of the kind apparent from the preamble of claims 1, 13, 22 and 27, respectively.

The invention thus relates to a stamp of the kind that is used during office work for marking of documents with a text line that occurs often, and a related method.

BACKGROUND OF THE INVENTION

Regular office stamps are usually provided with a stamp pad of a rubber like material. In the stamp pad, the text and/or the graphics appear like a raised layer. Photo chemical or thermoelectric methods are used to obtain stamp pads. Lately, computer controlled laser machines are used to burn off the material around the desired pattern. The stamp pad, after it has been produced, is mounted on a construction with a shaft. The shaft together with the stamp pad make up the actual stamp. In addition to this there is a type of pad filled with ink. The stamp is pressed against this pad so that a thin layer of ink stays in the stamp pad. Only the ink that is present on the raised layer of the stamp pad is transferred, when the stamp is pressed against a flat surface. In this way the desired pattern emerges.

In some embodiments of the stamps, the ink-filled pad is built into the shaft.

Stamp pads usually exist as standard or specially made pads, with a company logotype and/or address information.

If the company changes its address information, it is not possible to change the stamp pad, but a new one has to be manufactured, which leads to extra cost and also takes some time.

The fact that the text in the stamp pad always is the same, means that a clerk has to have a whole set of stamps for all kinds of applications, which takes up space, and the cost increases with every extra stamp.

In addition, various stamps are often provided with an extra stamp pad in the shape of a rubber band, that rotates in order to get out different figures or texts. The purpose of this is to complete a text line with a current date and/or time.

This adds an extra task to the clerks, namely to manually adjust the date and/or time.

There are indeed electronic stamp machines doing this automatically, but they comprise complicated electromechanical components, which increase the manufacturing costs considerably and make them far to clumsy, so that one has to insert the document in the stationary stamp.

OBJECTS OF THE INVENTION

It is an object of the present invention to overcome the above described disadvantages of the presently known stamps.

Thus, an object of the invention is to provide a standard electronic stamp, where the text can easily be changed and/or make it possible to browse between different stamp suggestions, which results in the avoidance of several different stamps.

Another object with a preferred embodiment of the invention is to provide a stamp, with a built-in clock that automatically adjusts the date and/or time and also has a simple construction accomplishing this at considerably lower costs and sizes than what is possible today.

SUMMARY OF THE INVENTION

These objects are achieved with an electronic stamp and method according to the attached claims 1 and 7 respectively.

Embodiments of the inventive electronic stamp are stated in the attached dependent claims.

The invention will now be explained further below, by way of examples, with reference to the accompanying drawings.

BRIEF DESCRIPTION OF THE DRAWINGS

FIG. 1 shows a top view of an electronic stamp according to the invention.

FIG. 2 shows a cross sectional view, cut A–A', of the electronic stamp of FIG. 1, where the print head is in the end position.

FIG. 5 shows a side view of the print head and steering beam of FIG. 2.

FIGS. 5*a* and 5*b* show wave shapes produced by the movements of the print head along the steering beams.

DETAILED DESCRIPTION OF THE PREFERRED EMBODIMENTS

Figure 3:
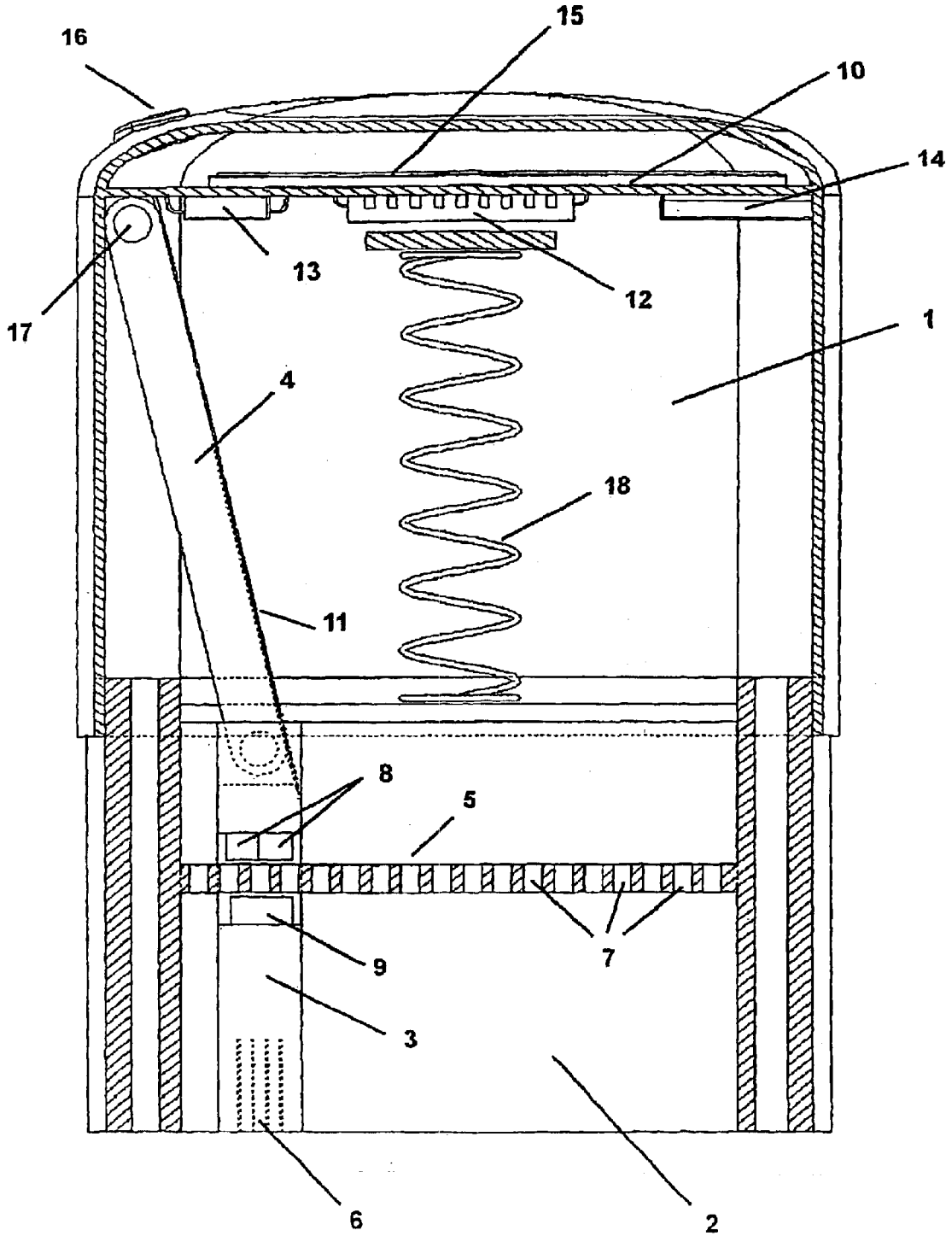
FIG. 3 shows the electronic stamp of FIG. 2, where the print head is in its starting position.

FIG. 1 shows a top view of an electronic stamp according to the present invention. The electronic stamp is seen including a display 15 (for example an ordinary LCD, liquid crystal display), an upper stamp housing 1 and set of buttons 16 for choosing an appropriate printout pattern.

In FIG. 2 the electronic stamp of FIG. 1 is shown from a cross sectional perspective, cut along A–A' in FIG. 1. The electronic stamp is shown comprising an upper stamp housing 1, embracing and sliding along a lower stamp housing 2, that is pressed against the printout surface where the stamping is to be performed. A print head 3 co-operates, via a lever 4, with the upper stamp housing 1 in order to move inside the lower stamp housing 2 along one or several beams 5, that can be used to steer the print head 3 in the lower stamp housing 2.

The print head 3 is of the type included in the so called ink jet printers, where several nozzles 6 under the influence of computer controlled electrical signals eject tiny ink drops, which then build up a predetermined pattern. Nozzles 6 are positioned in rows perpendicular to the steering beams 5. These rows are slightly displaced from one another so that each nozzle takes up an own line when the print head 3 moves along the steering beams 5.

The beams 5 are perforated by a great number of openings 7 placed with even intervals, close to one another. Fixed to the print head and in connection with the steering beams 5, there are one or several sets of double phototransistors 8. On the opposite side of the steering beams 5, and also fixed to the print head 3, there are one or several sources of light, as a suggestion infra-red, in the form of light emitting diodes 9.

The print head is attached to a control circuit 10 via a flexible cable 11. In the control circuit there are a micro controller circuit 12, a memory unit 13 where a certain number of prepared "stamps" are stored in digital form, and a data communication link 14 to a host computer. Via this communication link 14, the user can download new "stamps", and update or edit existing ones.

The user can, via the display 15 and the set of buttons 16, choose one for the moment appropriate stamp printout. The user then places the whole device over the place where he or she wishes the stamp printout to appear. When the user presses the upper stamp housing 1 down over the lower stamp housing 2, a spring 18 is compressed and, with the aid of the lever 4 and a pair of axes 17, the print head 3 moves along the steering beams 5, with the nozzles 6 some millimetres over the surface where the stamp printout is to be applied. This movement continues until the print head 3 reaches all the way to the other side of the lower stamp housing 2, the end position as shown in FIG. 2.

FIG. 3 shows a cross sectional view of an electronic stamp according to the foregoing embodiment, where the print head 3 is in the starting position before the upper stamp housing 1 is pressed down over the lower stamp housing 2. The print head 3 will move to the end position indicated in FIG. 2 when pressed.

Figure 4:
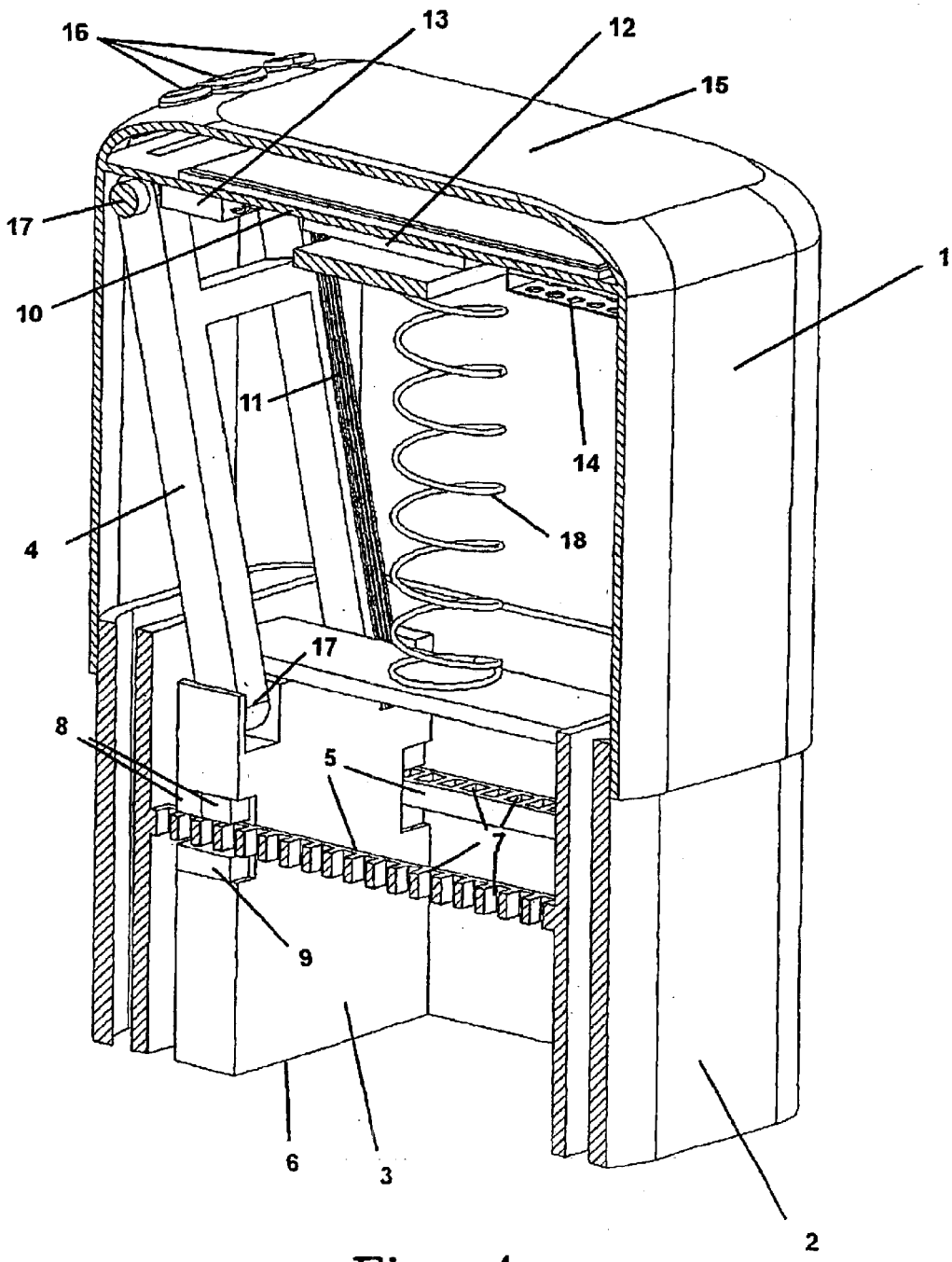
FIG. 4 shows a perspective view of the electronic stamp of FIGS. 1–3.

FIG. 4 shows a perspective view of the electronic stamp of FIGS. 1–3, where particularly the steering beams 5 with the openings 7 are seen.

How the exact position of the print head 3 is determined is apparent from the following.

With reference now to FIG. 5, the double phototransistors 8*a*, 8*b* senses the light from the light emitting diodes 9, the light being screened off or put through respectively by the openings 7 in the steering beams 5. As the print head 3 moves for example to the left (as indicated by the arrows in FIG. 5), the phototransistor 8*a* senses when the light is being screened off by the blocking parts of the steering beams (i.e. the parts between the openings 7), while the phototransistor 8*b* senses the light. This is used to determine the exact position of the print head. The double phototransistors 8*a*, 8*b* produce two quadrature signals that are 90 degrees off phase. Changes in the quadrature signals are registered by the micro controller circuit 12 via the cable 11 in order to, in real time, determine the direction and magnitude of the motion of the print head 3. From this then, the micro controller circuit 12 decides whether or not to send the electrical impulses that activate the nozzles 6.

FIGS. 5*a* and 5*b* show wave shapes produced by the movements of the print head 3 along the steering beams 5. A positive movement is, for example, defined such that certain wave shapes relate to a movement of the print head 3 from right to left, as shown in FIG. 5*a*. First both phototransistors 8*a* and 8*b* are turned off. Then phototransistor 8*a* reaches an opening 7, and is turned on. Thereafter the phototransistor 8*b* also reaches the opening and is also turned on, after which the phototransistor 8*a* reaches the first blocking part of the steering beams and is again turned off. This continues, and the wave shapes are created. If one compares ordinary channel sampling, including logical 1 and logical 0, to "8*a*8*b*", one can correlate a positive movement to a transition from "00" state to "10" state, where "00" corresponds to the state where both phototransistors 8*a* and 8*b* are off, and "10" corresponds to the state where the first phototransistor 8*a* is on and the second 8*b* is off. FIG. 5*a* thus shows a positive movement. At the same time a transition from "00" (both phototransistors off) to "01" (first phototransistor off, second on) show a negative movement, as illustrated in FIG. 5*b*. This could of course be reversed, so that transition "00" to "01" shows a positive movement (i.e. here from the left to the right) instead.

When the pressure from the user is suspended, the upper stamp housing 1 returns, and thereby the print head 3, to its original position under the influence of a spring 18. This is registered by the phototransistors as a negative movement according to the above, and thereby the printout process may be reset after the return of the print head 3.

Figure 6:
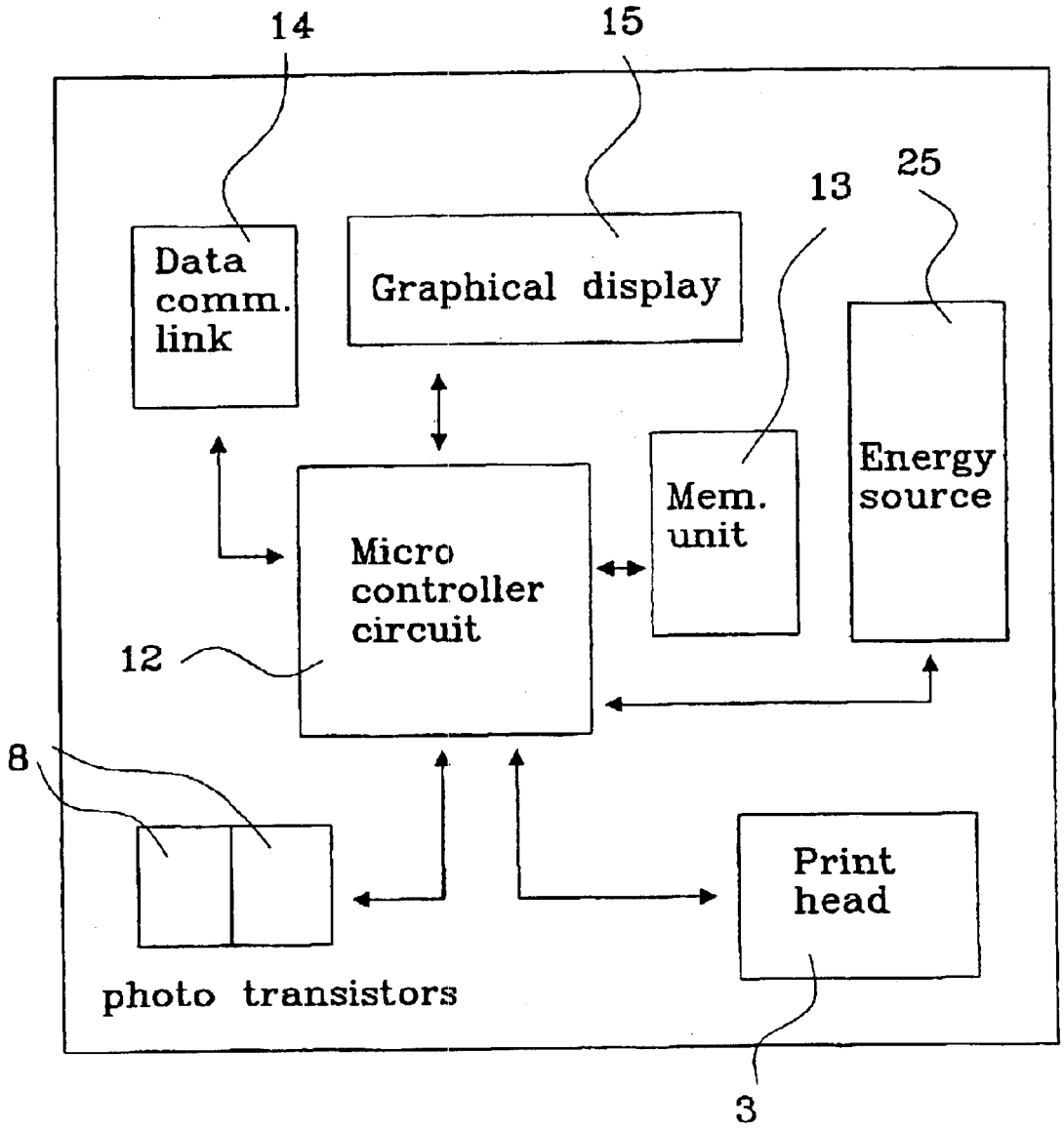
FIG. 6 shows a schematic overview of the components included in the electronic stamp of the present invention.

FIG. 6 shows a schematic overview of the components included in the electronic stamp of the present invention. All the components, i.e. a print head 3, phototransistors 8, a micro controller circuit 12, a memory unit 13, a data communication link 14, a graphical display 15 and an energy source 25, are small, are relatively cheap and readily available. This gives low manufacturing costs and a smaller size of the stamps than the stamps available today, thus not making it a stationary one. The electronic stamp may also include a circuit (not shown) providing the current time/date, in order to further facilitate the stamping.

Figure 7:
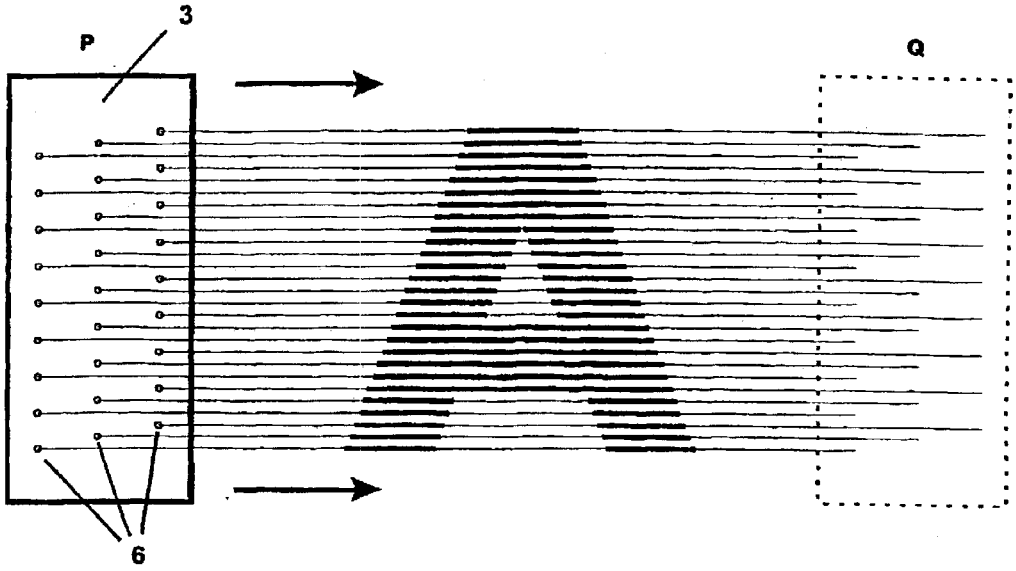
FIG. 7 shows a schematic view of the displaced positions of the rows of nozzles in the print head.

FIG. 7 shows a schematic view of the displaced positions of the rows of nozzles 6 in the print head 3, so that each nozzle opening takes up an own printout line. In FIG. 7 it is shown how the print head 3, with nozzles 6, moves to the right, from position P, over the printout surface, to position Q. This is one embodiment of the present invention, where the ink drops are ejected only in one direction of the movement of the print head 3. This printing in one direction only, can be used for example when one wishes to save ink, or when one is not in need of a particularly sharp printout. An alternative embodiment, with printing in both directions of the movement of the print head 3, is shown in FIG. 8.

Figure 8:
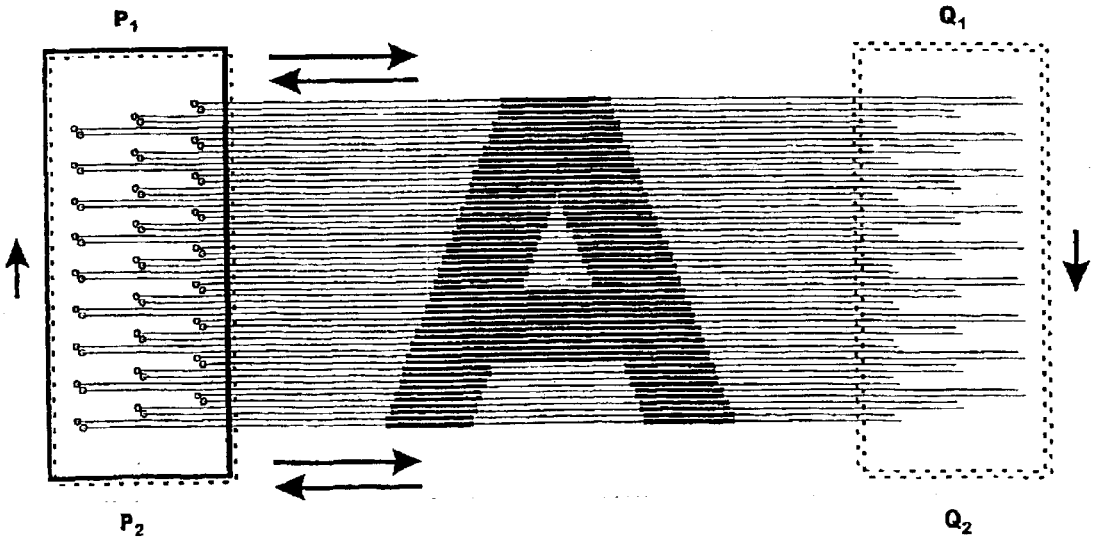
FIG. 8 shows a schematic view of the displaced positions of the rows of nozzles in the print head, when the print head prints in both directions.

The protruding and withdrawal of the print head 3 may thus occur on different paths, lying some millimetre apart from each other, as shown in FIG. 8. In this way one can use the withdrawal of the print head 3 in order to perform yet another ejection of ink drops over the stamp pattern, thereby achieving an even better coverage and/or resolution of the stamp pattern. When the print head 3 moves from position $P_1$ to position $Q_1$ (i.e. when the user presses down the stamp against the printout surface) the first printing is effected. When the print head 3 moves from position $Q_2$ to position $P_2$ (i.e. when the user releases the pressure on the stamp) the second printing is effected. The positions $P_1$, $Q_1$, $Q_2$ and $P_2$ will be described in more detail with reference to FIGS. 9*a* and 9*b*.

Figure 9A:
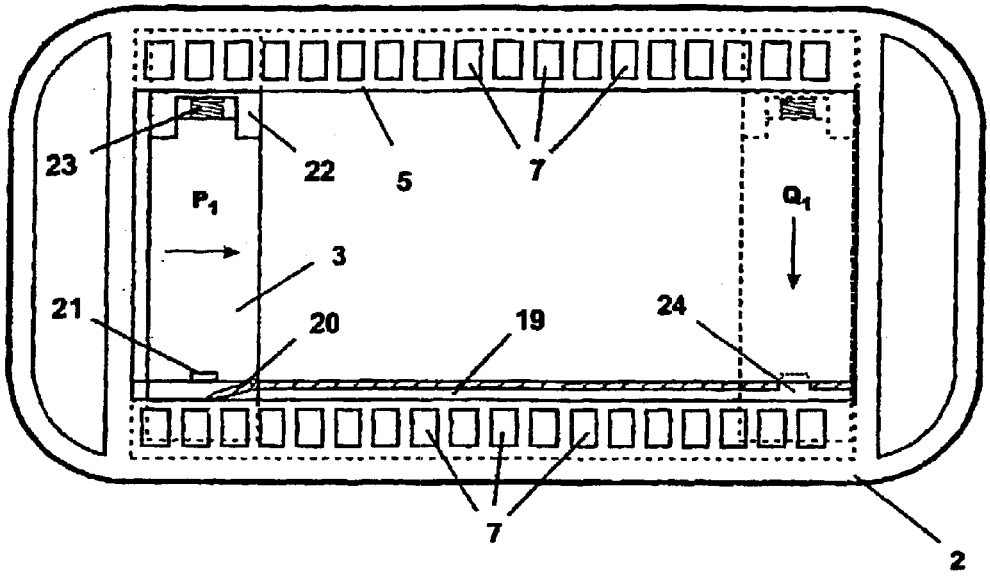
FIGS. 9*a* and 9*b* show a cross sectional top view of another embodiment of the electronic stamp according to the invention.
Figure 9B:
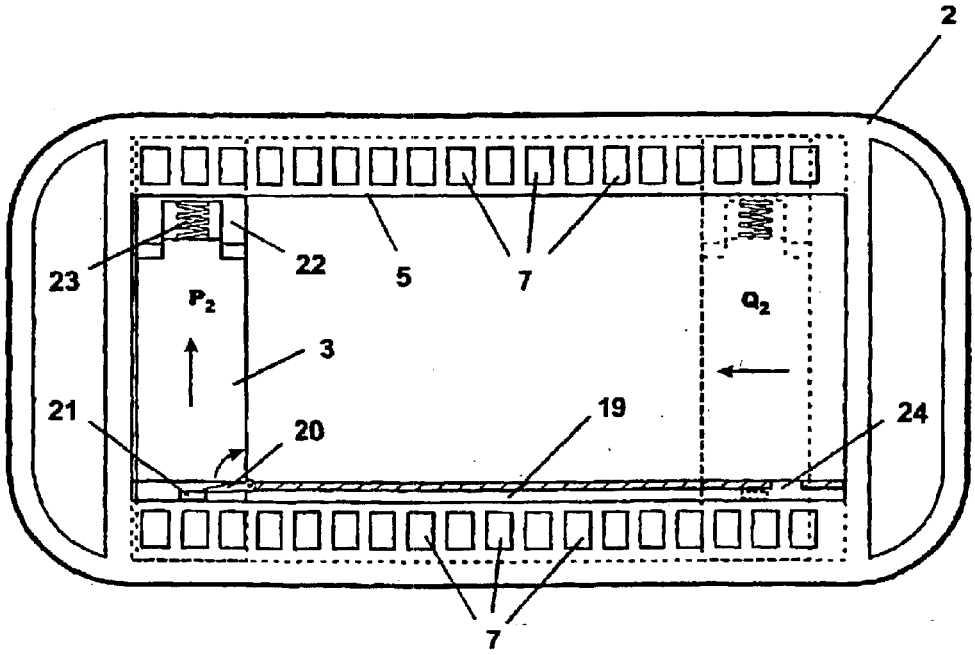

FIGS. 9*a* and 9*b* show a cross sectional top view of another embodiment of the invention, where a channel 19 is built in connection to one of the steering beams 5. At the beginning of the channel there is a resilient lamella 20, which is intended to function as a ramp to a pin 21 effected in the construction lying close to the print head 3. The print head 3 has a dilated part 22 with a built-in spring 23 that constantly presses the print head 3 in the direction towards the channel 19. At the end of the channel 19 there is an opening 24 whose width is greater than the width of the pin 21.

When the upper stamp housing 1, with the print head first being in position $P_1$, is pressed against the lower stamp housing 3, the print head 3 and thereby the pin 21 moves over the lamella, functioning as a ramp, and along the outside of the channel 19, to position $Q_1$. Now the first printing has been effected. When the print head 3 reaches the end of the channel 19, it is pressed through the opening 24 by the spring 23, the print head 3 now being in position $Q_2$, and moves back along the inside of the channel 19, to position $P_2$. When moving from $Q_2$ to $P_2$, the (optional) second printing is effected. The print head 3 thus moves back all the way to the original start position and through the resilient lamella 20, to position $P_1$.

Figure 10:
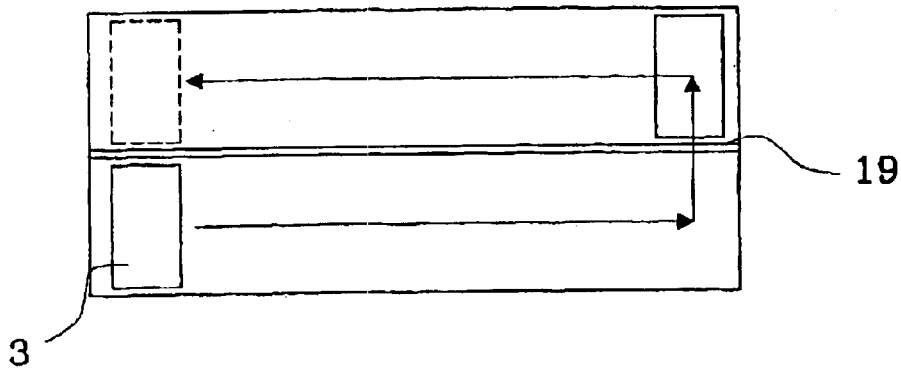
FIG. 10 shows an embodiment of the present invention giving printouts of greater width.

Another embodiment of the invention uses this idea of using a channel 19 and printing in both directions, but instead of having only one row of nozzles printing in the reverse (backward) direction, the entire print head 3 slides along one side of the channel, and prints in this direction, then slides back along the other side of the channel and prints in this direction too, see FIG. 10. In this way a printout with a greater width can be accomplished while still using the same width of the print head, i.e. a printout having double the size of the print head is possible. This is a cheaper solution than today, since a print head of standard size can be used for larger printouts.

In another embodiment of the inventive electronic stamp, the determination of the position of the print head and other related parameters (speed, direction etc.), may be effected in an entirely different manner, which will now be described.

In this embodiment the steering beams 5 are used only as regular steering beams, with no openings 7 needed. The phototransistors 8 are also eliminated in this embodiment. The light emitting diodes 9 are however needed, but are, together with optosensors, included on a circuit, which is placed on the underside of the print head 3. The light emitting diodes emit light, which is reflected on the printout surface and sensed by the optosensors. The optosensors thereby senses characteristics of the printout surface and can thereby, with the aid of the micro controller circuit 12, determine the position of the print head 3, the speed, acceleration and direction and/or other parameters. A component that could be used when implementing this solution is for example HDNS-2000, available from Agilent Technologies.

In yet another embodiment of the present invention, the print head may be angled a certain degree. When angling the print head, the printout lines made by the nozzles end up closer together and thereby increases the resolution. This is again a cheaper solution, since the same (simple) print head may be used while still giving a higher resolution. The resolution may be increased from 115 dpi to 130 or even up to 180 dpi, depending on the angle. If the angle is too great, the printout lines will overlap, and the resolution will decrease again.

Figure 11:
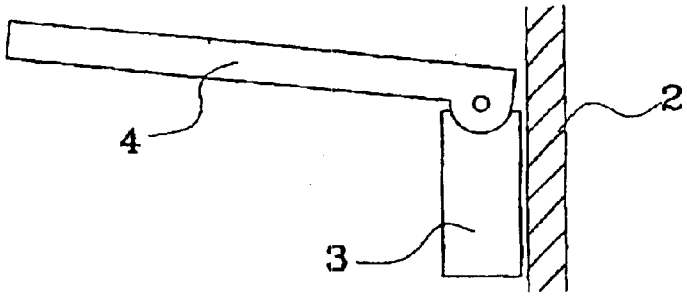
FIG. 11 shows an embodiment of the lever mechanism in the electronic stamp of the present invention.

In yet another embodiment, the lever mechanism has an alternative fastening. The lever is fastened to the print head in a manner so that it is not projecting outwardly, see FIG. 11. This results in that the print head can go nearer the side wall of the housing, and thus the working region of the print head is increased.

Another embodiment for fastening the steering beams to the print head is also possible. One may include small wheels to the fastening mechanism, so that the print head slides along the beam on these wheels. In this way the friction is reduced, and a possible source of failure is avoided.

Figure 13:
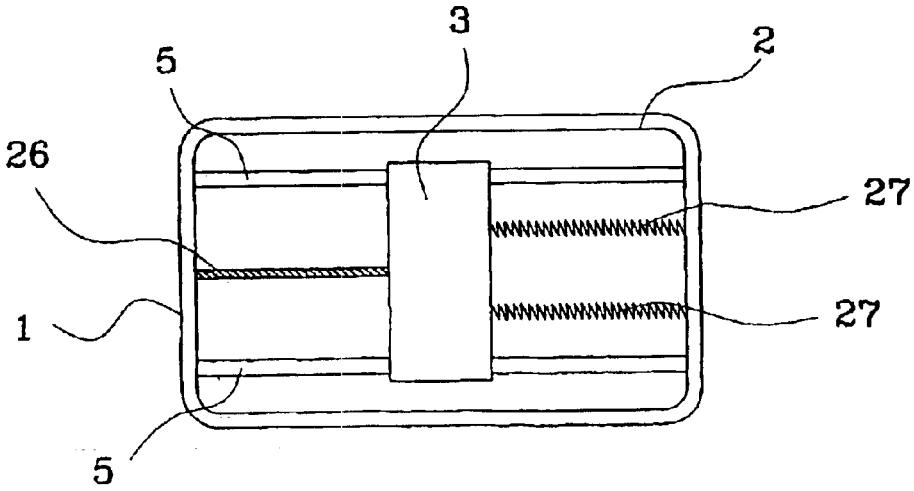
FIG. 13 shows the embodiment of FIG. 12 from underneath.
Figure 12A:
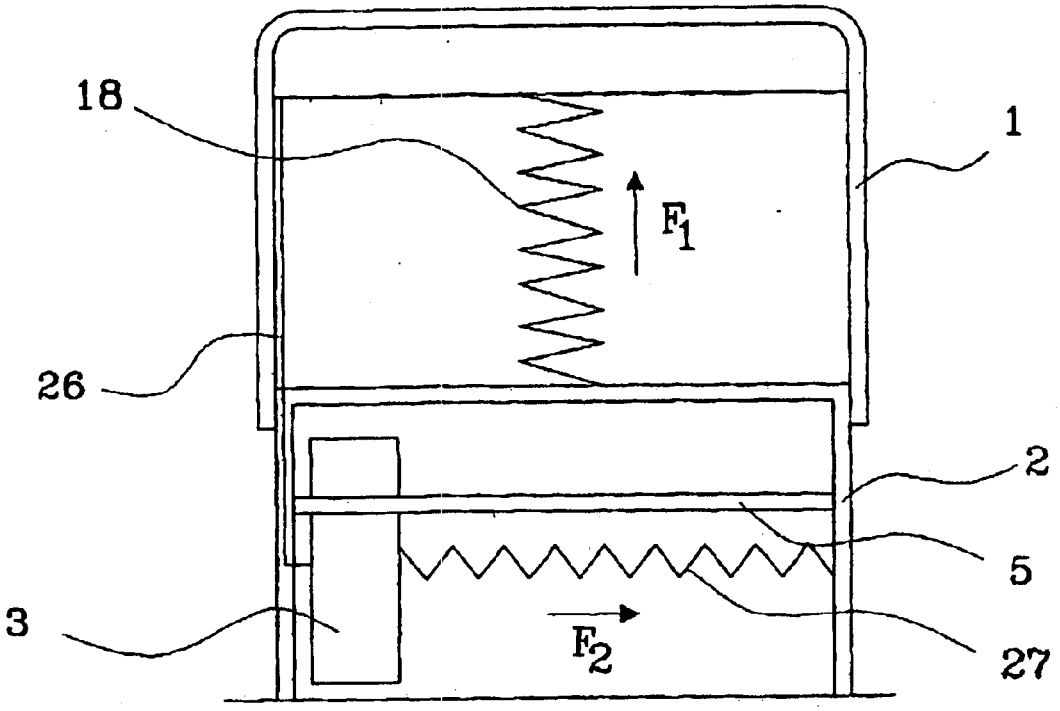
FIGS. 12*a–b* show another embodiment of the electronic stamp, with an alternative mechanism for moving the print head.
Figure 12B:
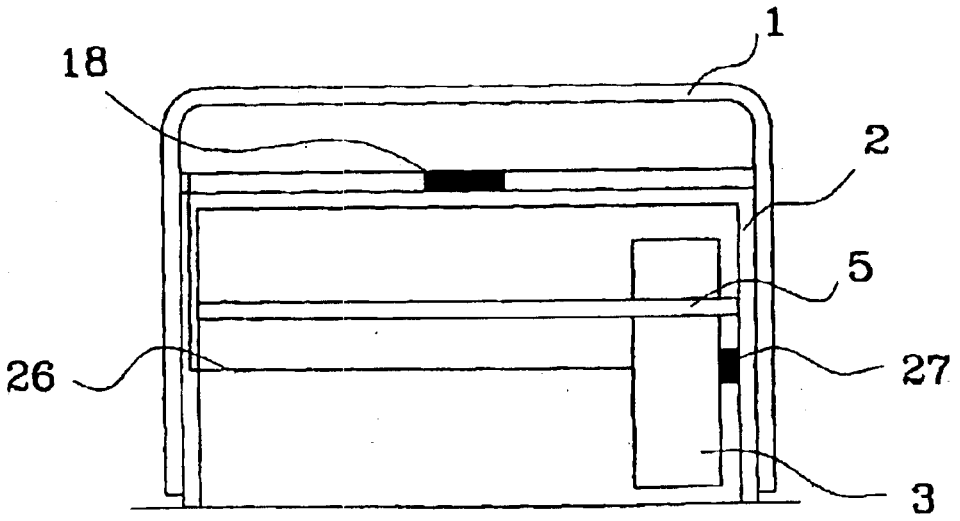

In further yet another embodiment, now with reference to FIGS. 12*a–b* and 13, the lever mechanism 4 is removed entirely. Instead, the print head 3 slides along steering beams 5, without ever undergoing the vertical movement. The vertical movement of the upper stamp housing is transformed into a horizontal movement of the print head. This is accomplished by having a cable or a wire 26, or the like, fastened between one side of the print head 3 and the upper stamp housing 1. The print head 3 is, on the opposite side to the wire 26 or like, fastened to one or more springs 27, which in turn on their other side are fastened to the side wall of the lower stamp housing 2. When the user presses down the upper stamp housing 1, the wire 26 is slackened, the springs 27 pull the print head 3 in one direction and the print head 3 thus moves in this direction. When the user then releases the pressure, the spring 18 draws the print head 3 back to the starting position. It is important that the spring force $F_1$ of the spring 18 is greater than the spring force $F_2$ of the one or more springs 27. This because else the upper stamp housing 1 would not be pulled back up. An advantage with this embodiment is that the working region is increased, since the print head 3 can move nearer the side walls of the lower stamp housing, than what is possible with the lever mechanism. How near is of course dependent on the length of the springs 27 when they are in their rest position. A further advantage with this solution is the fact that this gives lower manufacturing costs, since a fewer number of mechanical parts are needed.

What is claimed is:

1. An electronic stamp for effecting printouts comprising:

a printing mechanism;

an upper stamp housing (1);

a lower stamp housing (2); wherein said upper stamp housing (1) is movably arranged over said lower stamp housing (2), that is pressed against a printout surface characterised in that said printing mechanism comprises a print head (3), guided by one or more steering beams (5) in said lower stamp housing (2) and ejecting ink drops on said printout surface; and wherein said electronic stamp further comprises:

means for transforming a vertical movement of the upper stamp housing (1) into a horizontal movement of the print head (3) along the steering beam(s) (5), means for determining parameters of the movement of the print head (3), and means for controlling a stream of ink drops against said printout surface according to a predetermined pattern, in accordance with the determined parameters.

2. An electronic stamp as claimed in claim 1, characterised in that the electronic stamp further comprises a spring (18) in order to withdraw said upper stamp housing (1) and thereby the print head (3) to the starting position.

3. An electronic stamp as claimed in claim 1, characterised in that the electronic stamp further comprises a channel (19) built in connection to one of the steering beams (5), having a resilient lamelia (20) at the beginning of the channel (19) functioning as a ramp for a pin (21), and a dilated part (22) with a built-in spring (23) constantly pressing the print head (3) in the direction towards the channel, and an opening for being able to extend over two different parallel paths depending on the direction of movement.

4. An electronic stamp as claimed in claim 3, characterised in that the channel is a narrow channel and is used in order to achieve better resolution of the printout result.

5. An electronic stamp as claimed in claim 3, characterised in that the channel is a broad channel and is used in order to enable the whole print head (3) to print in two directions to achieve a printout with a greater width while still using the same width of the print head.

6. An electronic stamp as claimed in claim 1, characterised in that the electronic stamp further comprises means for tilting the print head (3) a certain degree, in order to make the printout lines, made by the nozzles of the print head (3), end up closer together and thereby increasing the resolution.

7. An electronic stamp as claimed in claim 1 characterised in that the movement of the print head (3) is determined by means of light emitting diodes and optosensors included in a circuit, which is placed on the underside of the print head (3), wherein the optosensors senses the characteristics of the printout surface when the light from the light emitting sources is reflected on the said printout surface; and wherein the circuit is co-operating with a micro controller circuit in order to determine parameters of the movement of the print head (3), which parameters are then used to steer and control a stream of ink drops against a surface and thus forming a predetermined pattern.

8. An electronic stamp as claimed in claim 1, characterised in that the movement of the print head (3) is determined by means of one or several sets of phototransistors (8) and light sources (9), mounted on the print head (3), so that at least one of the beams (5) with a sufficient number of openings (7) intercepts or puts through the light from the light sources (9) on its way to the phototransistors (8), resulting in wave shaped signals, and means for processing these signals by a micro controller circuit (12) in order to determine parameters of the movement of the print head (3), which parameters are then used to steer and control a stream of ink drops against a surface and thus forming a predetermined pattern.

9. An electronic stamp as claimed in claim 8 characterized in that there are two steering beams (5).

10. An electronic stamp as claimed in claim 1, characterised in that said transformation of the vertical movement of the upper stamp housing (1) into a horizontal movement of the print head (3) comprises a lever mechanism, wherein a lever arm (4) is pivotally fastened between the upper stamp housing (1) and the print head (3), accomplishing a horizontal movement of the print head (3).

11. An electronic stamp as claimed in claim 1, characterised in that said transformation of the vertical movement of the upper stamp housing (1) into a horizontal movement of the print head (3) comprises a spring mechanism, wherein one or more springs (27) are fastened between the print head (3) and the side wall of the lower stamp housing; a wire (26) is fastened between the other side of the print head (3) and the upper stamp housing (1); and wherein the wire (26) is slackened and the springs (27) are pulling the print head (3) in one direction when the upper stamp housing is pressed down over the lower stamp housing (2), and wherein the spring (18) draws the print head (3) back to the starting position when releasing the pressure on the upper stamp housing (1).

12. An electronic stamp as claimed in claim 1, characterised in that the parameters of the movement of the print head (3) comprises one or more of: the position, the direction of movement, the speed and the acceleration.

13. A method for effecting printouts by means of an electronic stamp comprising a printing mechanism, an upper stamp housing (1), a lower stamp housing (2), wherein said upper stamp housing (1) is movably arranged over said lower stamp housing (2), that is pressed against a printout surface characterised in that the printing mechanism comprises a print head (3) and one or more steering beams (5), said method comprising the steps of:

(a) moving said upper stamp housing (1) in relation to said lower stamp housing (2), accomplishing a vertical movement of said upper stamp housing (1), (b) transforming said vertical movement of the upper stamp housing (1) into a horizontal movement of the print head (3), which moves along the steering beam(s) (5), (c) determining parameters of the movement of the print head (3), and (d) controlling a stream of ink drops against said printout surface according to a predetermined pattern, in accordance with the determined parameters.

14. Method for effecting printouts by means of an electronic stamp as claimed in claim 13 characterised in that the method further comprises the step of:

withdrawing said upper stamp housing (1) and thereby the print head. (3) to its starting position by using a spring (18).

15. Method for effecting printouts by means of an electronic stamp as claimed in claim 13 characterised in that the method further comprises the step of:

performing the printout in two stages, where the print head (3) moves along an adapted path for each direction of movement of said print head (3) with the object to increase the resolution of the printout.

16. Method for effecting printouts by means of an electronic stamp as claimed in any of claims claim 13 characterised in that the method further comprises the step of:

tilting said print head (3) a certain degree in order to make the printout lines, made by nozzles of the print head (3), end up closer together and thereby increasing the resolution.

17. Method for effecting printouts by means of an electronic stamp as claimed in claim 13 characterised in that the transforming of said vertical movement in step (b) is performed by using a lever mechanism, wherein a lever arm (4) is pivotally fastened between the upper stamp housing (1) and the print head (3), accomplishing a horizontal movement of the print head (3).

18. Method for effecting printouts by means of an electronic stamp as claimed in claim 13 characterised in that the transforming of said vertical movement in step (b) is performed by a spring mechanism, wherein one or more springs (27) are fastened between the print head (3) and the side wall of the lower stamp housing; a wire (26) is fastened between the other side of the print head (3) and the upper stamp housing (1); and wherein the wire (26) is slackened and the springs (27) are puffing the print head (3) in one direction when the upper stamp housing is pressed down over the lower stamp housing (2), and wherein the spring (18) draws the print head (3) back to the starting position when releasing the pressure on the upper stamp housing (1).

19. Method for effecting printouts by means of an electronic stamp as claimed in claim 13 characterised in that the method further comprises the step of:

driving said print head (3) directly or indirectly by a manually driven, linear but non-predictable movement as concerning speed, acceleration and other parameters having influence on a print out of a predetermined pattern.

20. Method for effecting printouts by means of an electronic stamp as claimed in claim 13 characterised in that said step (c) is performed by:

providing phototransistors (8) and light emitting diodes mounted on the device movable print head (3), calculating said parameters in real time by a micro controller circuit (12) from signals from the phototransistors (8) and that these calculations are used to steer and control the stream of ink drops intended to form a predetermined printout pattern.

21. Method for effecting printouts by means of an electronic stamp as claimed in claim 13 characterised in that the method further comprises the step of:

establishing a data communication link (14) with a host computer in order to edit, update or complete a digital collection of possible stamp printouts stored in memory unit (13) in the electronic stamp.

* * * * *